US007089893B1

(12) United States Patent
Ostling

(10) Patent No.: US 7,089,893 B1
(45) Date of Patent: Aug. 15, 2006

(54) COMBUSTION ENGINE VALVE SYSTEM

(76) Inventor: David Ostling, 933 S. Geneva St., Denver, CO (US) 80231-5204

( * ) Notice: Subject to any disclaimer, the term of this patent is extended or adjusted under 35 U.S.C. 154(b) by 6 days.

(21) Appl. No.: 10/890,731

(22) Filed: Jul. 13, 2004

(51) Int. Cl.
*F01L 7/00* (2006.01)

(52) U.S. Cl. ..... 123/80 BA; 123/190.6; 123/190.8

(58) Field of Classification Search ..... 123/80 R, 123/80 BA, 190.4, 190.5, 190.6, 190.8, 190.11
See application file for complete search history.

(56) References Cited

U.S. PATENT DOCUMENTS

| | | | |
|---|---|---|---|
| 1,073,671 | A | 9/1913 | Fornaca |
| 1,119,494 | A | 12/1914 | Bournonville |
| 1,135,719 | A | 4/1915 | Ritter |
| 1,215,993 | A | 2/1917 | Rimbach |
| 1,218,296 | A | 3/1917 | Moorhead |
| 2,082,231 | A | 6/1937 | Strickland |
| 2,156,749 | A | 5/1939 | Baker |
| 3,893,483 | A | 7/1975 | Ackerman |
| 3,945,364 | A | 3/1976 | Cook |
| 4,077,382 | A | 3/1978 | Gentile |
| 4,473,041 | A | 9/1984 | Lyons et al. |
| 4,562,796 | A | 1/1986 | Eickmann |
| 4,879,979 | A | 11/1989 | Triguero |
| 4,889,088 | A | 12/1989 | Berger |
| 4,944,261 | A | 7/1990 | Coates |
| 5,052,349 | A | 10/1991 | Buelna |
| 5,074,265 | A | 12/1991 | Ristin et al. |
| 5,152,259 | A | 10/1992 | Bell |
| 5,249,553 | A | 10/1993 | Guiod |
| 5,490,485 | A | 2/1996 | Kutlucinar |
| 5,724,926 | A | 3/1998 | Wilke |
| 5,967,108 | A | 10/1999 | Kutlucinar |
| 6,029,617 | A | 2/2000 | Lambert et al. |
| 6,443,110 | B1 | 9/2002 | Qattan |

FOREIGN PATENT DOCUMENTS

| | | | |
|---|---|---|---|
| CH | 642143 | A5 * | 3/1984 |

* cited by examiner

*Primary Examiner*—Noah P. Kamen
(74) *Attorney, Agent, or Firm*—Ramon L. Pizarro; Edwin W. Crabtree

(57) ABSTRACT

A valve system for a combustion engine that includes at least one combustion chamber is disclosed. The combustion chamber includes an intake port and an exhaust port. The valve system includes cylindrical valve shaft, the cylindrical valve shaft having a cylindrical surface, a central axis along the cylindrical valve shaft and containing at least two recessed areas, the recessed areas being at one hundred eighty degrees to one another along the axis of the valve shaft, the recessed areas extending approximately ninety degrees about the axis and along the cylindrical surface, or about 25 percent of the surface.

11 Claims, 11 Drawing Sheets

COMBUSTION ENGINE VALVE SYSTEM

BACKGROUND OF THE INVENTION (a) Field of the Invention

This invention generally relates to a valve system for allowing intake and exhaust of combustion gasses for an internal combustion engine. More particularly, but not by way of limitation, to an axial valve system that rotates along an axis to allow the introduction and release of gasses from a combustion chamber.

(b) Discussion of Known Art

Axially rotating valve systems for internal combustion engines have been known for some time. Examples of these systems or devices are listed below:

| U.S. Pat. No. | Inventor | Date of Issue |
|---|---|---|
| 6,443,110 | Qattan | Sep. 3, 2002 |
| 5,249,553 | Guiod | Oct. 5, 1993 |
| 4,944,261 | Coates | Jul. 31, 1990 |
| 4,889,088 | Berger | Dec. 26, 1989 |
| 4,562,796 | Eickmann | Jan. 7, 1986 |
| 3,526,216 | Henvaux | Sep. 1, 1970 |
| 4,077,382 | Gentile | Mar. 7, 1978 |
| 1,135,719 | Ritter | Apr. 13, 1915 |

These known devices are designed to present an aperture or recessed area along a shaft to the top or inside of the cylinder of an internal combustion engine at a desired moment in the combustion or exhaust cycle. These apertures or recessed areas in the shaft are used as passages for intake and exhaust gasses during the cycle of the engine. It is important to note that while the majority of the discussion provided herein will focus on internal combustion engines, it is contemplated that the principles taught herein may also be applicable to expansion engines, such as steam engines.

U.S. Pat. No. 5,249,553 to Guiod is illustrative of the approach taken by many designers of rotary valve systems. The Guiod device teaches the use of a shaft with indents that are designed to provide "unrestricted and direct" flow of air/fuel into the combustion chamber of the engine. Furthermore, the Guiod device asserts that the indents are designed to assist the rotating shafts in forcing the exhaust into the exhaust manifold and in forcing the air/fuel mixture into the combustion chamber. Unfortunately, how the Guiod indents assist the rotating shafts in forcing gasses into the exhaust manifold or the combustion chamber is not explained in the Guiod specification.

Still further, the "unrestricted and direct" approach of Guiod suggests the absence or very limited interaction between the indents and the flow of gas mixtures into and out of the combustion chamber. Accordingly, the lack of contact between the structure of the rotating shafts of Guiod and the flow of these gasses provides little insight into how the energy contained in this flow can be harnessed. Still further, it is well known that the exhaust gasses in particular are still expanding as they flow out of the combustion chamber, and thus there remains a need for a system that allows the harnessing of the energy being released through the expansion of these gasses.

One of the purposes for using rotary valve systems is the increase in efficiency that appears to be possible with the rotary valve versus the use of poppet type valves. Poppet type valve systems require the use of energy to overcome the springs that hold the valves in a closed position. Furthermore, poppet valves provide a great deal of resistance to the flow of gasses into and out of the combustion chamber. Still further, poppet valve systems use a reciprocating motion, which inevitably results in noise and vibration.

Accordingly, a review of known valve systems for piston engines indicates that there is a need for a rotary valve system that provides the advantages of efficient low flow restriction of rotary valves, and that does so with the use of few moving parts.

There remains a need for a rotary valve system that can remain dimensionally stable in applications that involve high temperature gasses, such as internal combustion engines.

The beneficial use of ceramic materials for both the valve shaft and the cylinder head minimizes thermal expansion during normal and high demand operating conditions. Additionally, ceramic material minimizes the heat transfer between the hot exhaust gasses and associated components and the cooler fuel/air intake mixture and associated components. Furthermore, the inherent property of ceramics makes for more options to attain gas tight seals.

Still further, there remains a need for a valve system that harnesses the energy associated with the flow of gasses out of the piston engine, and thus improving the efficiency of the overall system. This is accomplished by where the curvature of the valve shaft exhaust recessed area forces the energy from exhaust gasses to pass through the valve shaft at a right angle from the combustion chamber which exerts an opposite reaction on the valve shaft in a manner that pushes the recessed area to rotate the valve shaft in the opposite direction of the flow of the exhaust gasses.

SUMMARY

It has been discovered that the problems left unanswered by known art can be solved by providing a rotary valve system for allowing the delivery and exhaust of gasses into the cylinders of a combustion engine. The combustion engine including at least one combustion chamber that includes an intake port and an exhaust port, the intake port allowing delivery of a combustion mixture into the combustion chamber, the exhaust port allowing exhaust gasses to leave the combustion chamber, the valve system including:

A cylindrical valve shaft, the cylindrical valve shaft having a cylindrical surface, a central axis along the cylindrical valve shaft and containing at least two recessed areas, the recessed areas being at one hundred eighty degrees to one another along the axis of the valve shaft, the recessed areas extending approximately ninety degrees about the axis and along the cylindrical surface, or about 25 percent of the surface;

a valve support head that supports the cylindrical valve shaft, the valve support head including an intake port having an entry that has been adapted to terminate along the cylindrical surface of the cylindrical valve shaft, and an exhaust port the intake port being adapted to terminate along the cylindrical surface of the cylindrical valve shaft, the intake port and the exhaust port each extending approximately forty five degrees about along the surface of the cylindrical valve shaft, measured along the axis of the cylindrical valve shaft;

a combustion chamber that includes a cylinder and a piston slideably mounted within the cylinder, the piston being connected to a connecting rod that is in turn connected to a crankshaft.

According to a highly preferred example of the invention the recessed areas are of equal size and shape so that the valve shaft is balanced. The shaft is rotatably mounted over the intake port and exhaust port in a manner allowing the combustion mixture to flow through the intake recessed area and into the combustion chamber and exhaust gasses to flow out the combustion chamber through the exhaust recessed area and out to the exhaust manifold. Upon rotation of the valve shaft the intake recessed area comes into communication with the intake manifold first and then with the combustion chamber and the exhaust recessed area comes into communication with the combustion chamber first and then the to exhaust manifold. This design specifically utilizes energy from exhaust gasses and is an integrated, dynamic function of overall engine power output.

The crankshaft of this example is connected to the valve shaft such that the crankshaft rotates twice for every single rotation of the valve shaft for accurate timing and transition of gasses on the intake and exhaust cycles.

The valve shaft being mechanically connected to the crankshaft such that the curved exhaust recessed area harnesses energy on the exhaust stroke by redirecting the momentum of the exhaust gasses to flow from a direction that is parallel with the direction of motion of the piston to a direction that is approximately ninety degrees from the direction of motion of the piston before proceeding out and into the exhaust manifold, thereby transferring momentum onto the surfaces of the recessed areas and forcing the valve shaft to move rotationally with equal force in the opposite direction. This increases overall engine efficiency.

In a preferred example of the invention the communication between the combustion chamber and the recesses in the cylindrical valve shaft that lead to the exhaust manifold include a generally converging or funnel-shaped section that concentrated and aligns the flow of exit gasses such that they are focused to flow directly against the rounded surface of the exhaust recessed portion.

The intake recessed area or portion will be generally curved, and allow the harness of kinetic energy from the gasses or mixture that is flowing into the combustion chamber by a similar action as described in connection with the exhaust recessed portion.

Thus it will be understood that the disclosed system will harness kinetic energy from the gasses flowing into the combustion chamber as well as from the gasses flowing out of the combustion chamber by causing a change in direction of flow of preferably about ninety degrees.

It should also be understood that while the above and other advantages and results of the present invention will become apparent to those skilled in the art from the following detailed description and accompanying drawings, showing the contemplated novel construction, combinations and elements as herein described, and more particularly defined by the appended claims, it should be clearly understood that changes in the precise embodiments of the herein disclosed invention are meant to be included within the scope of the claims, except insofar as they may be precluded by the prior art.

DRAWINGS

The accompanying drawings illustrate preferred embodiments of the present invention according to the best mode presently devised for making and using the instant invention, and in which.

DETAILED DESCRIPTION OF PREFERRED EXEMPLAR EMBODIMENTS

While the invention will be described and disclosed here in connection with certain preferred embodiments, the description is not intended to limit the invention to the specific embodiments shown and described here, but rather the invention is intended to cover all alternative embodiments and modifications that fall within the spirit and scope of the invention as defined by the claims included herein as well as any equivalents of the disclosed and claimed invention.

Figure 1:
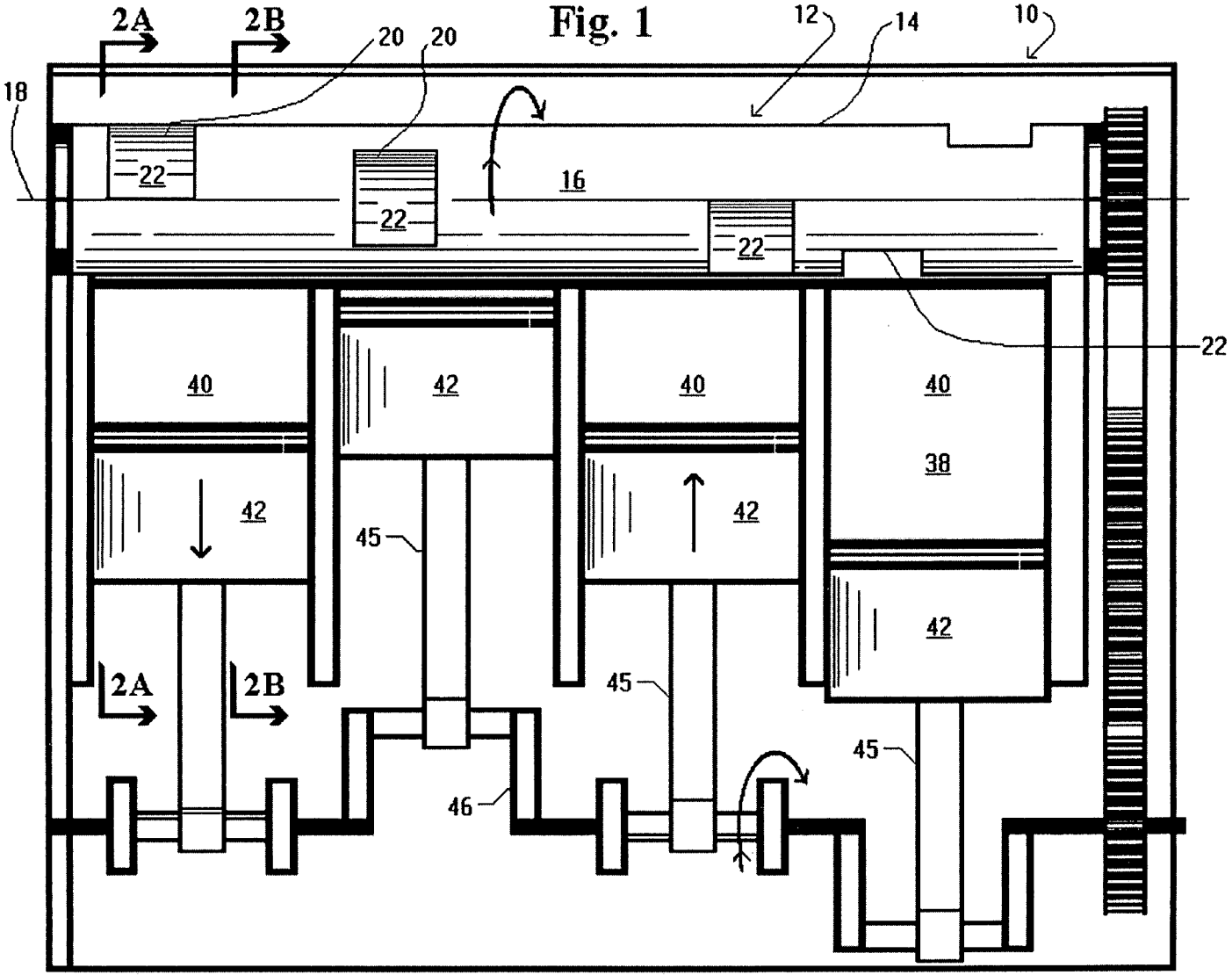
FIG. 1 is a side sectional view illustrating the use of the disclosed valve system in conjunction with a piston engine.

Turning now to FIG. 1 where an internal combustion engine 10 having a valve system 12 that incorporates an example of the inventive has been illustrated. The valve system 12 the internal combustion engine 10 include a cylindrical valve shaft 14 that includes a cylindrical surface 16 that extends along a central axis 18 of the cylindrical valve shaft 14. The cylindrical surface 16 includes at least two recessed areas 20 that are at about one hundred eighty degrees to one another along the axis 18 of the valve shaft 14.

Figure 9B:
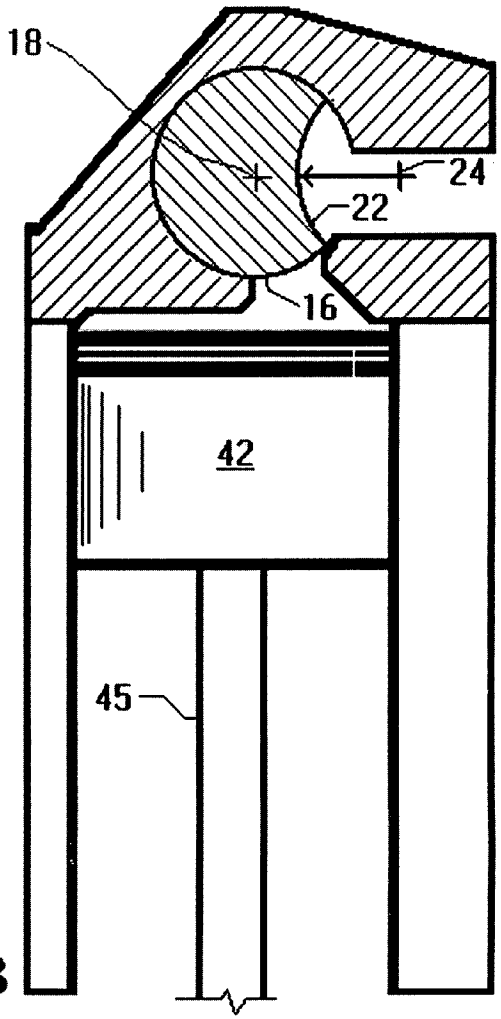
FIG. 9B is a section of the intake valve mechanism taken at the location shown on FIG. 1 after having advanced from the position shown on FIG. 8B and corresponding with the position of the exhaust valve mechanism shown on FIG. 9A.
Figure 9A:
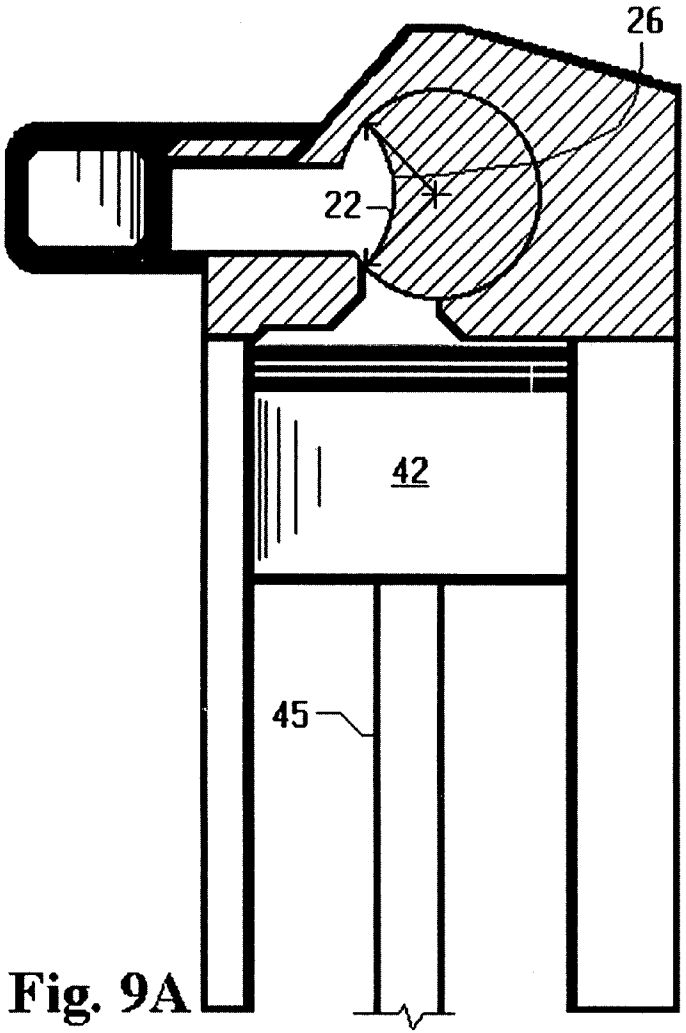
FIG. 9A is a section of the exhaust valve mechanism taken at the location shown on FIG. 1 after having advanced from the position shown on FIG. 8A.

It is contemplated that each of the recessed areas 20 will include a concave generally cylindrical surface 22 that are centered about a recess axis 24 (see FIG. 9B). The recess axes 24 being generally parallel to the central axis 18, and the cylindrical surface 22 extending approximately ninety degrees along an arc 26 that is centered along the central axis 18 and is generally parallel to the cylindrical surface 22. Still further, it is contemplated that each of the recessed areas 20 will be shaped as a concave cylindrical recess that extends into the cylindrical surface 22.

Figure 2B:
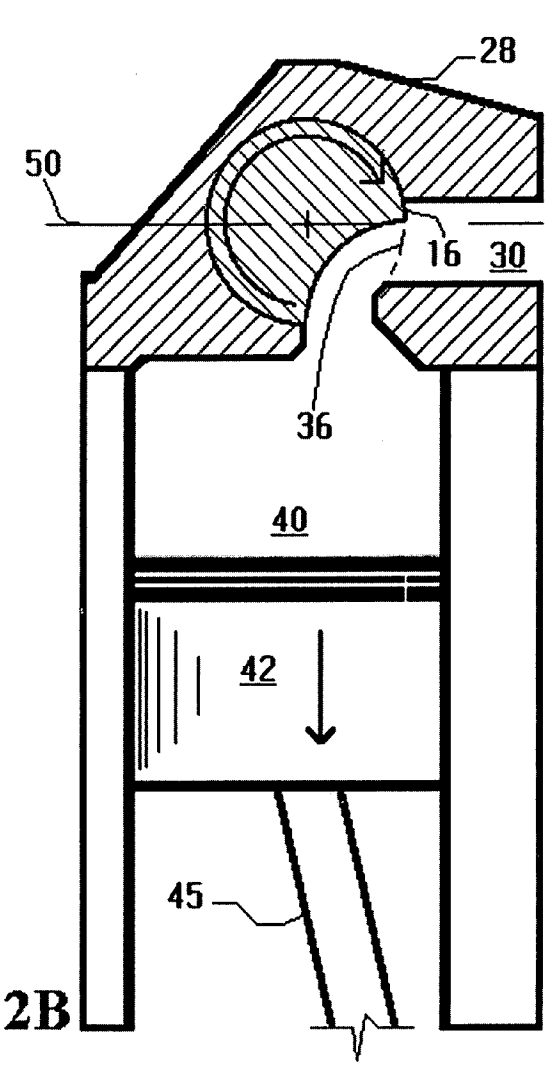
FIG. 2B is a section of the intake valve mechanism taken from FIG. 1.
Figure 2A:
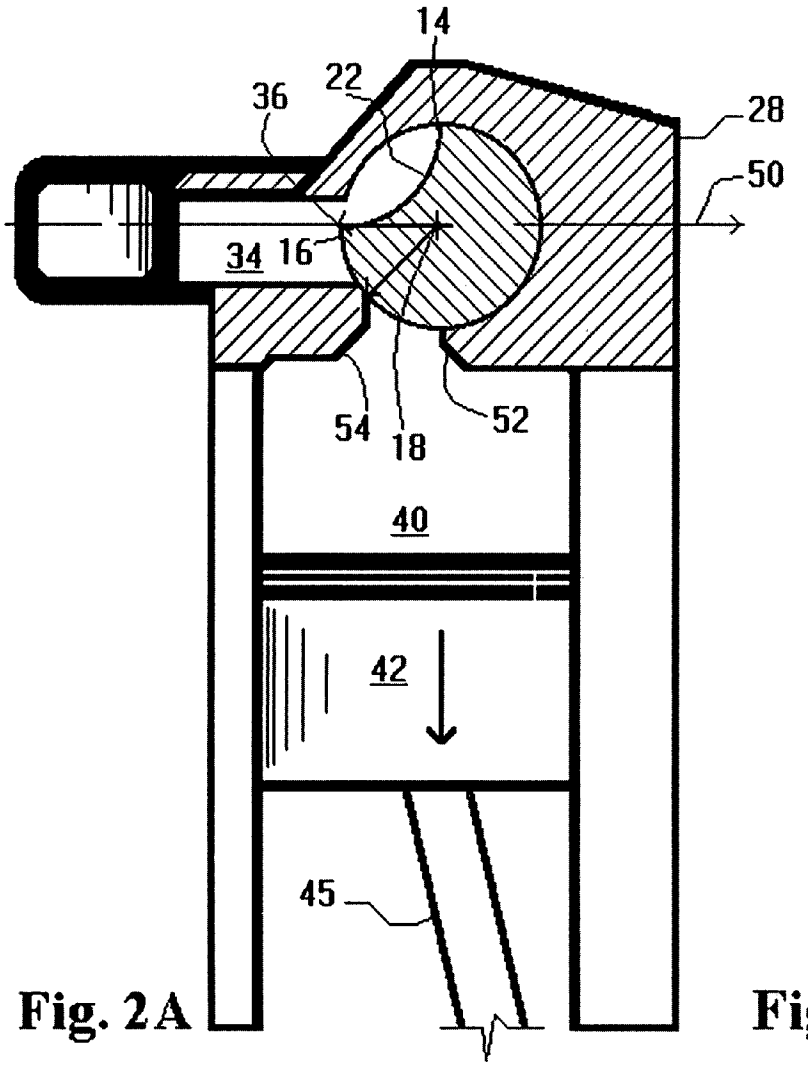
FIG. 2A is a section of the exhaust valve mechanism taken from FIG. 1.
Figure 3B:
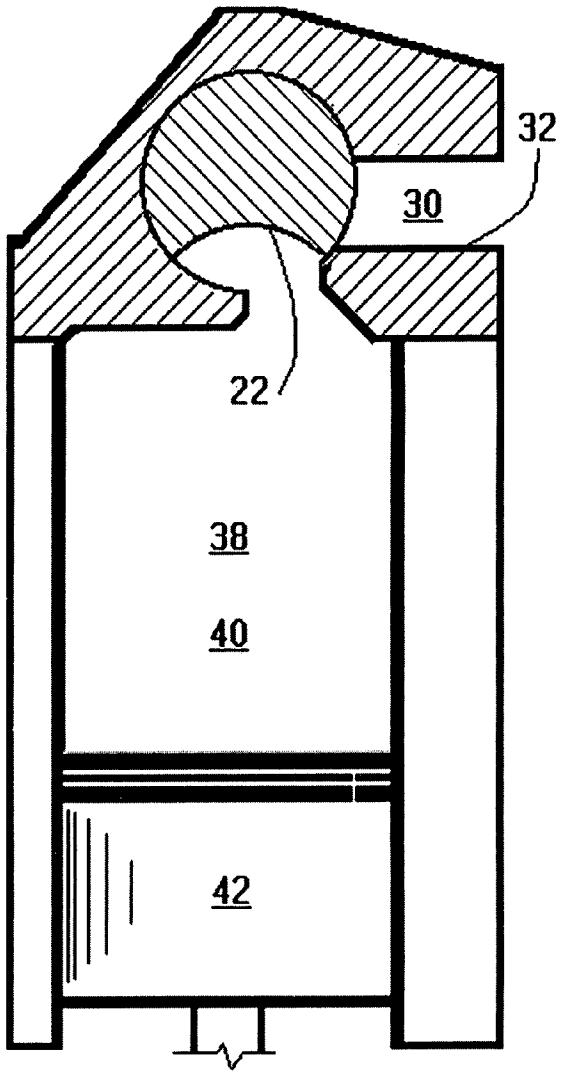
FIG. 3B is a section of the intake valve mechanism taken at the location shown on FIG. 1 after having advanced from the position shown on FIG. 2B and corresponding with the position of the exhaust valve mechanism shown on FIG. 3A.
Figure 3A:
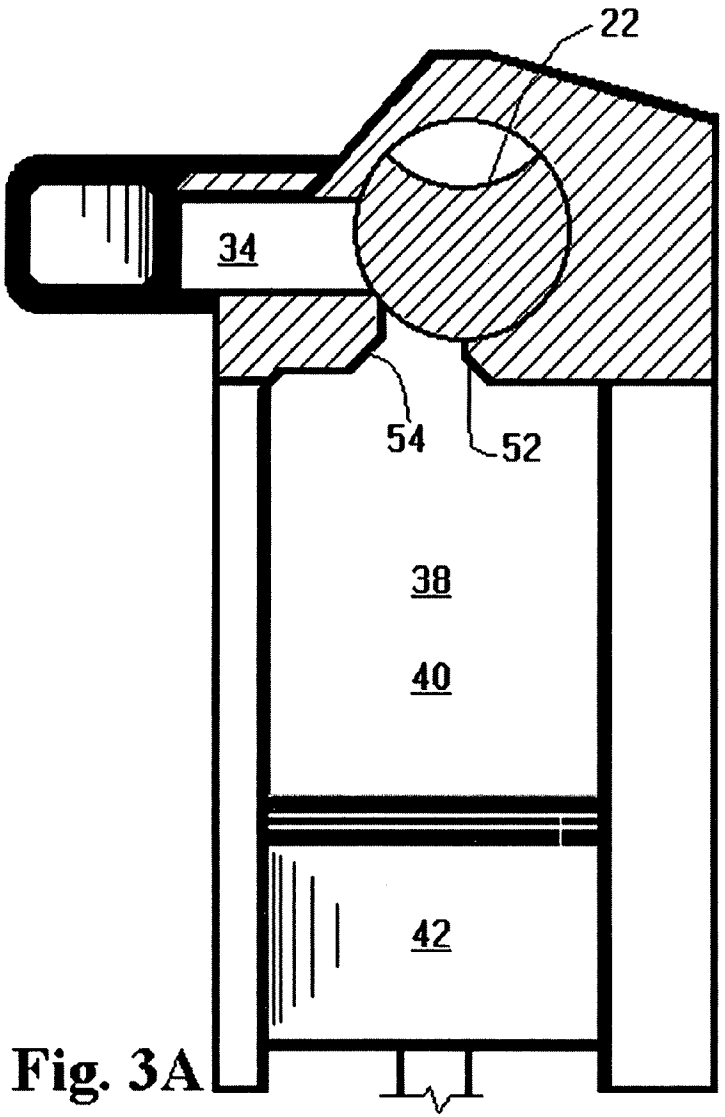
FIG. 3A is a section of the exhaust valve mechanism taken at the location shown on FIG. 1 after having advanced from the position shown on FIG. 2A.
Figure 4A:
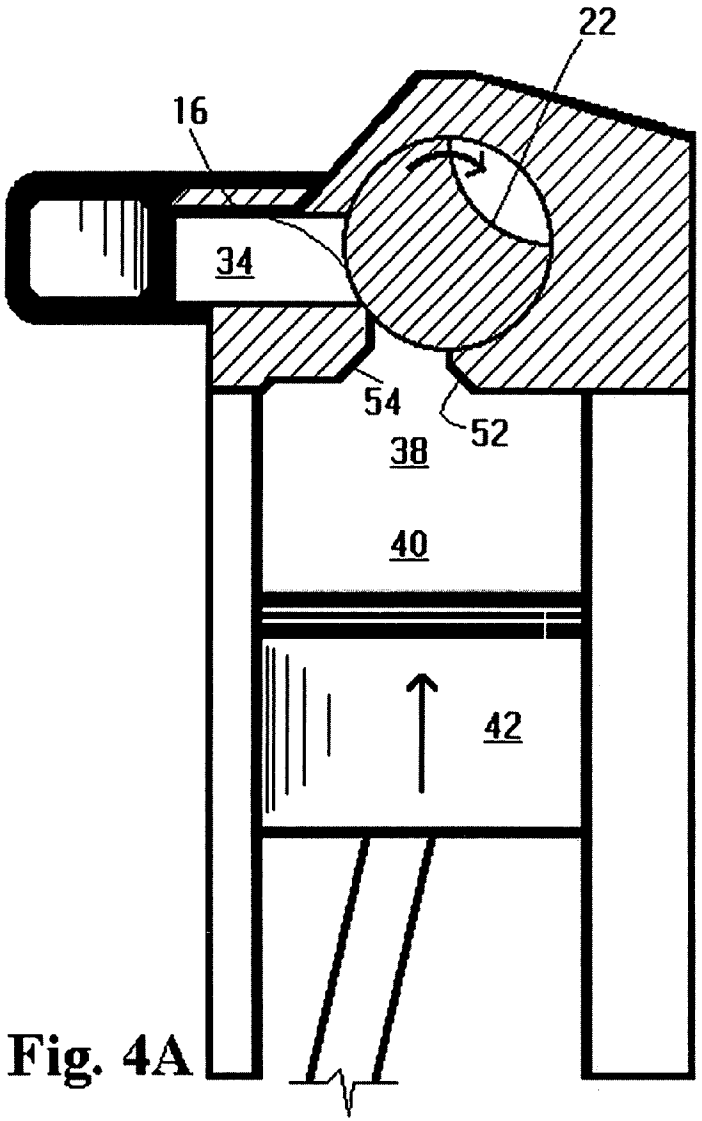
FIG. 4A is a section of the exhaust valve mechanism taken at the location shown on FIG. 1 after having advanced from the position shown on FIG. 3A.
Figure 4B:
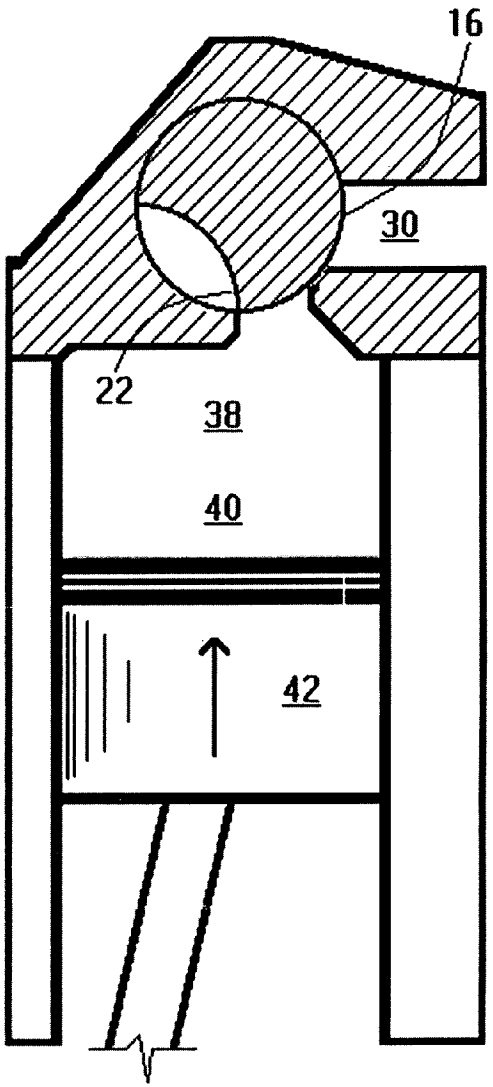
FIG. 4B is a section of the intake valve mechanism taken at the location shown on FIG. 1 after having advanced from the position shown on FIG. 3B and corresponding with the position of the exhaust valve mechanism shown on FIG. 4A.
Figure 5B:
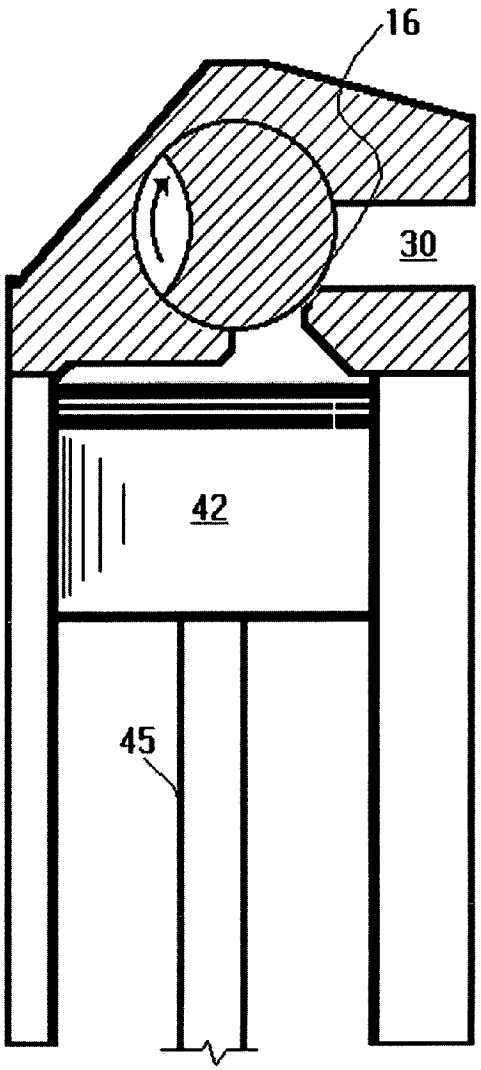
FIG. 5B is a section of the intake valve mechanism taken at the location shown on FIG. 1 after having advanced from the position shown on FIG. 4B and corresponding with the position of the exhaust valve mechanism shown on FIG. 5A.
Figure 5A:
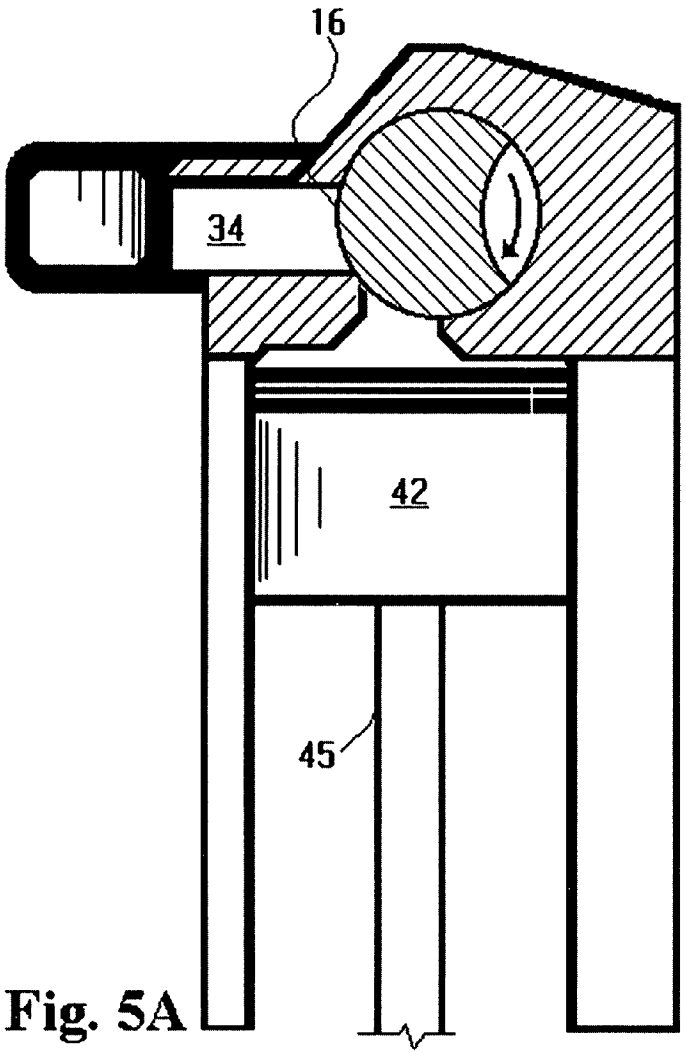
FIG. 5A is a section of the exhaust valve mechanism taken at the location shown on FIG. 1 after having advanced from the position shown on FIG. 4A.
Figure 6B:
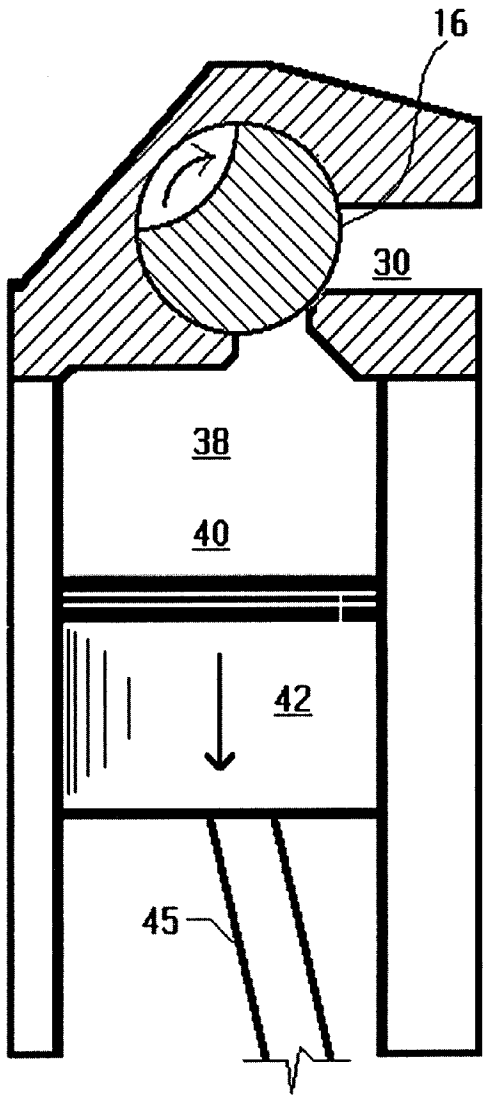
FIG. 6B is a section of the intake valve mechanism taken at the location shown on FIG. 1 after having advanced from the position shown on FIG. 5B and corresponding with the position of the exhaust valve mechanism shown on FIG. 6A.
Figure 6A:
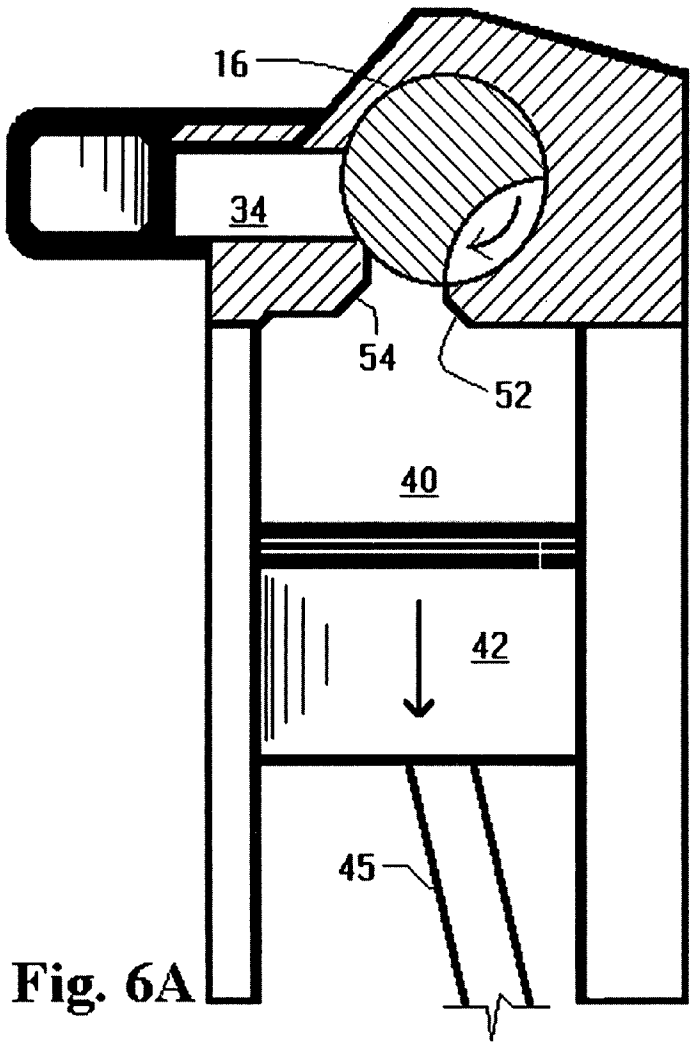
FIG. 6A is a section of the exhaust valve mechanism taken at the location shown on FIG. 1 after having advanced from the position shown on FIG. 5A.
Figure 7B:
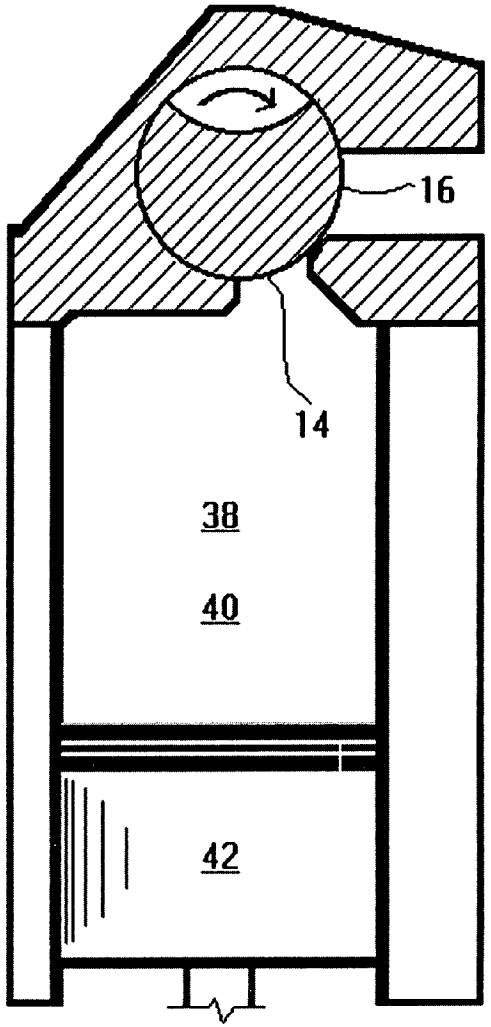
FIG. 7B is a section of the intake valve mechanism taken at the location shown on FIG. 1 after having advanced from the position shown on FIG. 6B and corresponding with the position of the exhaust valve mechanism shown on FIG. 7A.
Figure 7A:
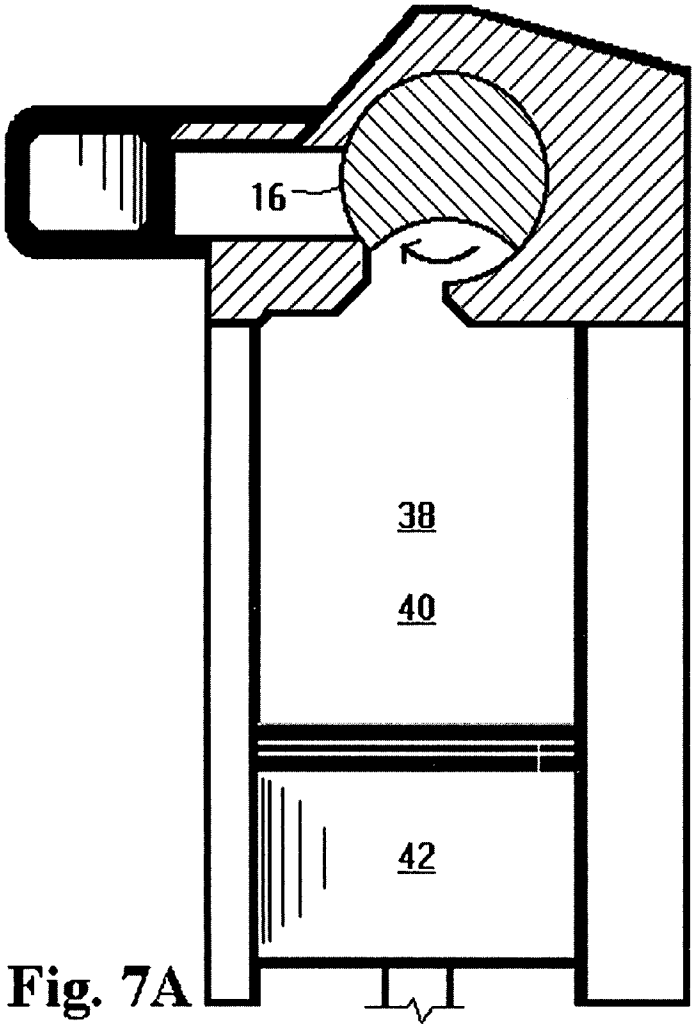
FIG. 7A is a section of the exhaust valve mechanism taken at the location shown on FIG. 1 after having advanced from the position shown on FIG. 6A.
Figure 8B:
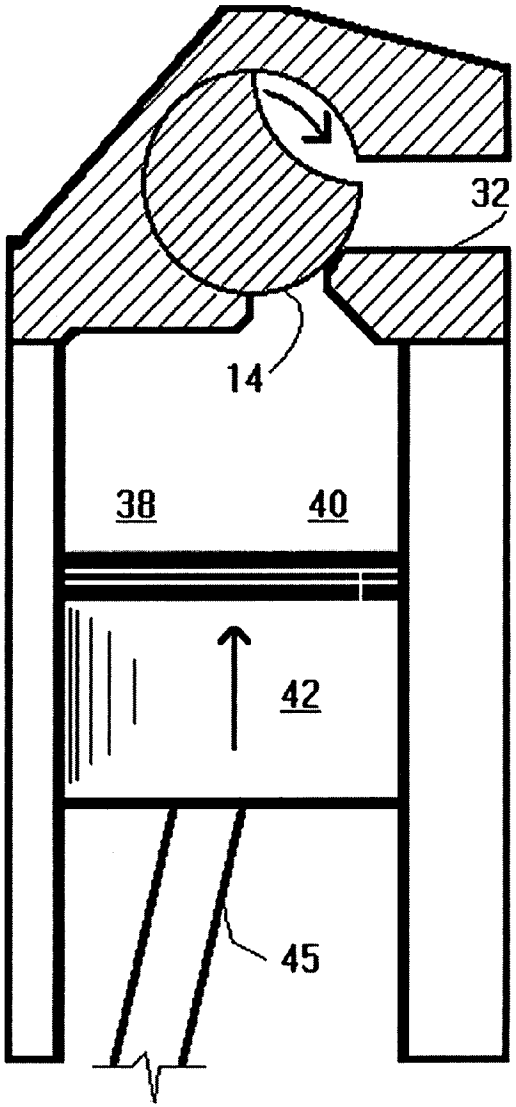
FIG. 8B is a section of the intake valve mechanism taken at the location shown on FIG. 1 after having advanced from the position shown on FIG. 7B and corresponding with the position of the exhaust valve mechanism shown on FIG. 8A.
Figure 8A:
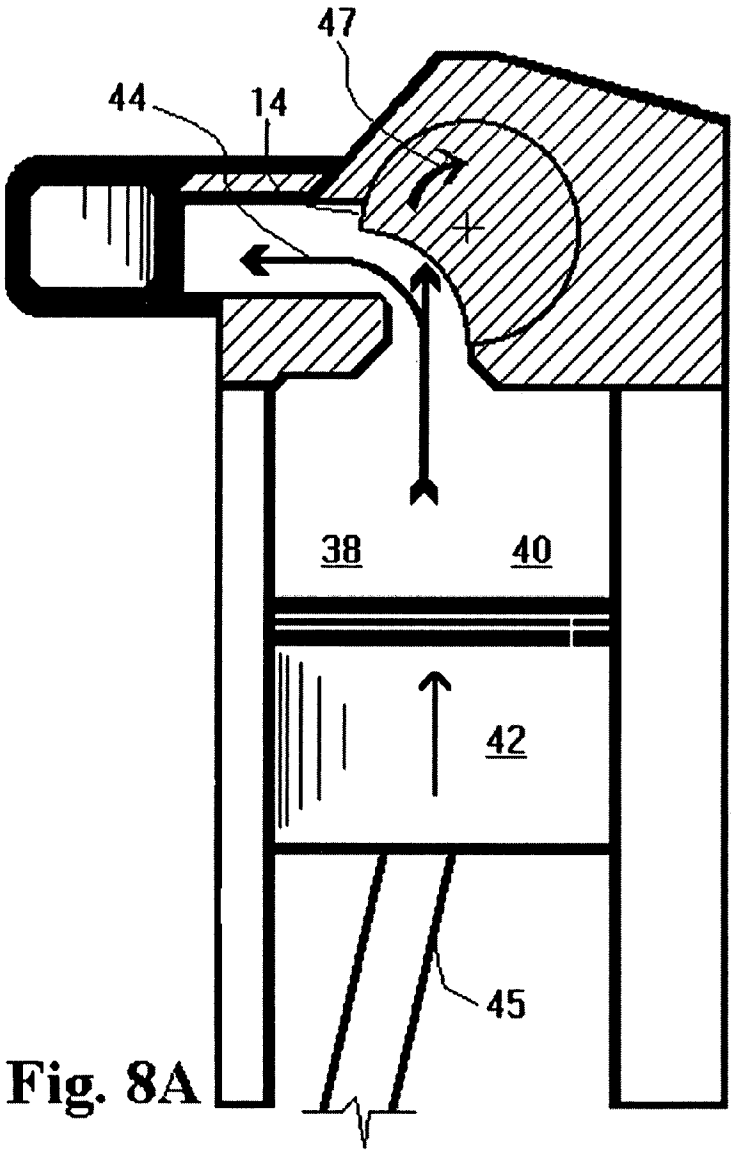
FIG. 8A is a section of the exhaust valve mechanism taken at the location shown on FIG. 1 after having advanced from the position shown on FIG. 7A.

As illustrated in FIGS. 2A and 2B, the cylindrical valve shaft 14 will be mounted on a valve support head 28, which should be made of a material that has similar thermal conductivity and expansion and contraction characteristics as the cylindrical valve shaft 14, and like the cylindrical valve shaft 14, will also be made of a ceramic or ceramic composite material. According to the illustrated example, the valve support head 28 will preferably include an intake port 30 that has an entry 32 that has been adapted to terminate along the cylindrical surface 16 of the cylindrical valve shaft 14. Additionally, it is contemplated that the support head 28 will also incorporate an exhaust port 34. As shown in the enclosed figures, the intake port 30 will preferably end along the cylindrical surface 16 of the cylindrical valve shaft 14. Additionally, the intake port 30 and the exhaust port 34 will each extending approximately forty five degrees along a chord 36 measured along the surface 16 of the cylindrical valve shaft 16. As illustrated in FIGS. 2–10, the chord 36 is measured about the axis 18 of the cylindrical valve shaft 14.

Figure 10:
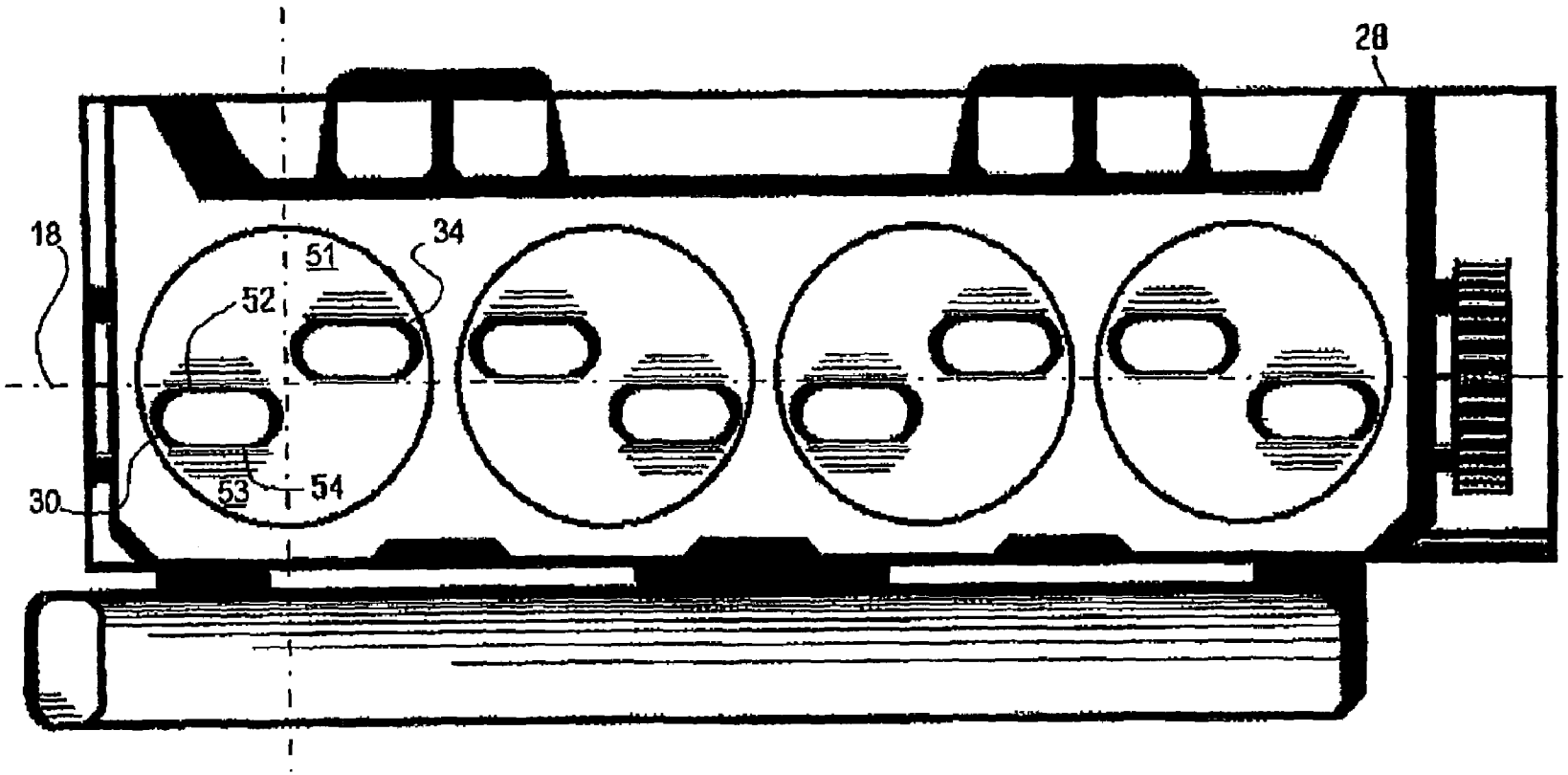
FIG. 10 illustrates entrance of the converging or funnel-shaped ducts that lead to the inlet and exhaust ports through the head.

The enclosed figures, particularly FIGS. 2A–9B, and FIG. 10, the intake port 30, which is of an elongated shape, and the exhaust port 34, which is also of an elongated shape, will be positioned along a plane 50 on the head 28. FIG. 10 illustrates that the elongated intake port 30 and the elongated exhaust port 34 lie on diagonally opposite quadrants 51, 53 of the valve support head. The exhaust duct 52 includes a converging surface 54 that converges from the cylinder 40 towards the cylindrical valve shaft 14. It is contemplated that the converging surface 54 will serve to accelerate exhaust gasses as they exit the cylinder 40 towards the recessed areas 20 on the cylindrical valve shaft 14. This acceleration, coupled with the positioning and timing of the rotation of the recessed areas during the exhaust portion of the combustion cycle will allow the disclosed system to provide reduces flow restriction while allowing the cylindrical valve shaft to harness some of the kinetic energy contained in the exhaust gasses as they flow past the recessed areas 20.

Figure 11:
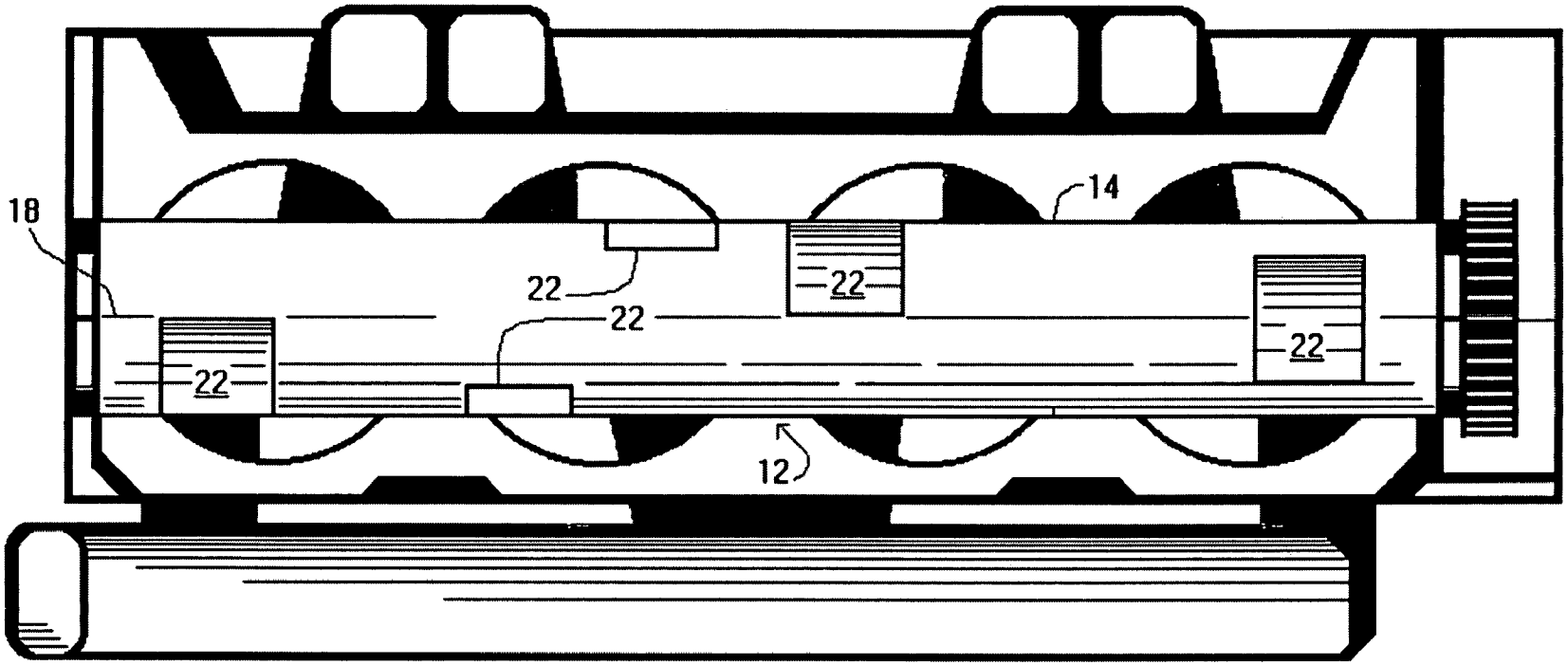
FIG. 11 illustrates a preferred positioning of the valve mechanism over the cylinders of the motor.

As illustrated in the enclosed figures, and particularly in FIGS. 1 and 11 the support head 28 will be mounted over a combustion chamber 38. Furthermore, it will be understood that the valve support head 28 will be in fluid communication with the intake port 30 and the exhaust port 34. Still further, the combustion chamber 38 will include a cylinder 40 and a piston 42 that is slideably mounted within the cylinder 40. The piston 42 will in turn be connected to a connecting rod 45 that is connected to a crankshaft 46 that is also connected to the cylindrical valve shaft 14.

Referring to FIGS. 2A–9B it will be understood that as the piston 42 moves up along the cylinder 40, the timing or rotational positioning of the cylindrical recessed areas 20 will be such that the concave generally cylindrical surfaces 22 are positioned over the exhaust port 34 such that exhaust gasses 44 impose a rotational force 47 on the cylindrical valve shaft 14. Thus as illustrated in FIG. 8A the exhaust gasses 44 will travel through the exhaust port 34 while the cylindrical surface 22 of one of the recessed areas 20 is generally tangent to the exhaust port 34.

Thus it can be appreciated that the above-described embodiments are illustrative of just a few of the numerous variations of arrangements of the disclosed elements used to carry out the disclosed invention. Moreover, while the invention has been particularly shown, described and illustrated in detail with reference to preferred embodiments and modifications thereof, it should be understood that the foregoing and other modifications are exemplary only, and that equivalent changes in form and detail may be made without departing from the true spirit and scope of the invention as claimed, except as precluded by the prior art.

What is claimed is:

1. An internal combustion engine comprising:

a valve system comprising a cylindrical valve shaft, the cylindrical valve shaft having a cylindrical surface that extends along a central axis along the cylindrical valve shaft, the cylindrical surface containing at least two recessed areas, each being concave cylindrical recesses, the recessed areas being at one hundred eighty degrees to one another along the axis of the valve shaft, the recessed areas extending approximately ninety degrees along an arc about the central axis and along the cylindrical surface;

a valve support head that supports the cylindrical valve shaft, the valve support head including an elongated intake port having an entry that has been adapted to terminate along the cylindrical surface of the cylindrical valve shaft, and an elongated exhaust port, the exhaust port terminating along the cylindrical surface of the cylindrical valve shaft, the intake port and the exhaust port each extending approximately forty five degrees along a chord along the surface of the cylindrical valve shaft, measured about the axis of the cylindrical valve shaft;

a combustion chamber that is in fluid communication with said intake port and said exhaust port, the combustion chamber including a cylinder and a piston that is slide-ably mounted within the cylinder, the elongated intake port and the elongated exhaust port being parallel to one another and parallel to the cylindrical valve shaft, both of the elongated intake port and the elongated exhaust port lying along different locations along the cylindrical valve shaft, and the elongated intake port and the elongated exhaust port being on opposite sides of the central axis of the valve shaft, such that the elongated intake port and the elongated exhaust port lie on diagonally opposite quadrants of the valve support head, the piston being connected to a connecting rod that is in turn connected to a crankshaft that is also connected to the cylindrical valve shaft.

2. An internal combustion engine according to claim 1 wherein the recessed areas are concave cylindrical recesses.

3. An internal combustion engine according to claim 1 wherein said recessed areas include a cylindrical surface that extends approximately ninety degrees.

4. An internal combustion engine according to claim 1 wherein the intake port and the exhaust port of said head lie along a plane.

5. An internal combustion engine according to claim 4 wherein said head contains an inlet duct and an exhaust duct that are positioned between the cylindrical valve shaft and the cylinder, and said exhaust duct includes a converging surface that converges from cylinder towards the cylindrical valve shaft.

6. An internal combustion engine comprising:

a valve system comprising a cylindrical valve shaft, the cylindrical valve shaft having a cylindrical surface that extends along a central axis along the cylindrical valve shaft, the cylindrical surface containing at least two concave cylindrical recessed areas, the recessed areas being at one hundred eighty degrees to one another along the axis of the valve shaft, each of the recessed areas having concave generally cylindrical surfaces that are centered about a recess axis, each of the recess axes being generally parallel to central axis and extending approximately ninety degrees along an arc about the central axis and along the cylindrical surface;

a valve support head that supports the cylindrical valve shaft, the valve support head including an elongated intake port having an entry that has been adapted to terminate along the cylindrical surface of the cylindrical valve shaft, and an elongated exhaust port, the exhaust port terminating along the cylindrical surface of the cylindrical valve shaft, the intake port and the exhaust port each extending approximately forty five degrees along a chord along the surface of the cylindrical valve shaft, the chord measured about the axis of the cylindrical valve shaft;

a combustion chamber that is covered by the valve support head and is in fluid communication with said intake port and said exhaust port, the combustion chamber including a cylinder and a piston that is slide-ably mounted within the cylinder, the elongated intake port and the elongated exhaust port being parallel to one another and parallel to the cylindrical valve shaft, both of the elongated intake port and the elongated exhaust port lying along different locations along the cylindrical valve shaft, and the elongated intake port and the elongated exhaust port being on opposite sides of the central axis of the valve shaft, such that the elongated intake port and the elongated exhaust port lie on diagonally opposite quadrants of the valve support head, the piston being connected to a connecting rod that is in turn connected to a crankshaft that is also connected to the cylindrical valve shaft.

7. An internal combustion engine according to claim 6 wherein the recessed areas are concave cylindrical recesses.

8. An internal combustion engine according to claim 6 wherein said recessed areas include a cylindrical surface that extends approximately ninety degrees.

9. An internal combustion engine according to claim 6 wherein the intake port and the exhaust port of said head lie along a plane.

10. An internal combustion engine according to claim 9 wherein said head contains an inlet duct and an exhaust duct that are positioned between the cylindrical valve shaft and the cylinder, and said exhaust duct includes a converging surface that converges from cylinder towards the cylindrical valve shaft.

11. A method for enhancing the efficiency of an internal combustion engine, the method comprising:

providing a valve system having a cylindrical valve shaft that includes a cylindrical surface that extends along a central axis of the cylindrical valve shaft, the cylindrical surface containing at least two recessed areas, the recessed areas being at one hundred eighty degrees to one another along the axis of the valve shaft, each of the recessed areas having concave generally cylindrical surfaces that are centered about a recess axis, each of the recess axes being generally parallel to central axis and extending approximately ninety degrees along an arc about the central axis and along the cylindrical surface;

providing a valve support head that supports the cylindrical valve shaft, the valve support head including an elongated intake port having an entry that has been adapted to terminate along the cylindrical surface of the cylindrical valve shaft, and an elongated exhaust port, the exhaust port terminating along the cylindrical surface of the cylindrical valve shaft, the intake port and the exhaust port each extending approximately forty five degrees along a chord along the surface of the cylindrical valve shaft, the chord measured about the axis of the cylindrical valve shaft;

providing a combustion chamber that is covered by the valve support head and is in fluid communication with said intake port and said exhaust port, the combustion chamber including a cylinder and a piston that is slide-ably mounted within the cylinder, the elongated intake port and the elongated exhaust port being parallel to one another and parallel to the cylindrical valve shaft, both of the elongated intake port and the elongated exhaust port lying along different locations along the cylindrical valve shaft, and the elongated intake port and the elongated exhaust port being on opposite sides of the central axis of the valve shaft, such that the elongated intake port and the elongated exhaust port lie on diagonally opposite quadrants of the valve support head, the piston being connected to a connecting rod that is in turn connected to a crankshaft that is also connected to the cylindrical valve shaft; and imparting a rotational force on the cylindrical valve shaft by urging an amount of exhaust gasses through the exhaust port while the cylindrical surface of one of the recessed areas is tangent to the exhaust port.

* * * * *